US009138877B2

(12) United States Patent
Ploeger

(10) Patent No.: US 9,138,877 B2
(45) Date of Patent: Sep. 22, 2015

(54) PUSH ROD REMOVAL TOOL

(71) Applicant: Lisle Corporation, Clarinda, IA (US)

(72) Inventor: Randall J. Ploeger, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 275 days.

(21) Appl. No.: 13/743,489

(22) Filed: Jan. 17, 2013

(65) Prior Publication Data

US 2014/0196265 A1 Jul. 17, 2014

(51) Int. Cl.

| | |
|---|---|
| ***B23P 19/04*** | (2006.01) |
| ***B25B 27/00*** | (2006.01) |
| ***B25B 27/04*** | (2006.01) |

(52) U.S. Cl.

CPC ..... *B25B 27/0035* (2013.01); *B25B 27/04* (2013.01); *Y10T 29/53578* (2015.01)

(58) Field of Classification Search

CPC ..... B25B 27/0035

USPC ..... 29/219, 270–278, 220, 225; 269/2, 6, 269/95; 254/21, 25, 28; 81/3.05–3.57

See application file for complete search history.

(56) References Cited

U.S. PATENT DOCUMENTS

| | | | | |
|---|---|---|---|---|
| 5,775,673 | A * | 7/1998 | Carnes et al. | 254/131 |
| 6,385,834 | B2 * | 5/2002 | Thermos et al. | 29/278 |
| 7,409,755 | B2 * | 8/2008 | Smith et al. | 29/219 |
| 7,827,884 | B2 * | 11/2010 | Lawson | 81/3.09 |
| 2007/0017465 | A1 * | 1/2007 | Smith et al. | 123/90.42 |

OTHER PUBLICATIONS

Terry Ford, Idea relating to Pushrod Removal Tool, Lisle Corporation Idea Disclosure Agreement, IDA No. 05-447, Oct. 17, 2005, Clarinda, Iowa.

Cameron Waters, Idea relating to 3.1-3.4 L. GM Rocker Arm Tool, Lisle Corporation Idea Disclosure Agreement, IDA No. 05-307, Jul. 27, 2005, Clarinda, Iowa.

* cited by examiner

*Primary Examiner* — Lee D Wilson
*Assistant Examiner* — Jon Taylor
(74) *Attorney, Agent, or Firm* — Banner & Witcoff, Ltd.

(57) ABSTRACT

A tool for engaging and pivoting the rocker arm of an internal combustion engine to enable removal of a push rod from the engine by disengaging the rocker arm from the push rod includes a handle, a pair of bifurcated arms extending from the handle which fit on opposite sides of the rocker arm and further including connected outer ends of the bifurcated arms defining a prong to depress the valve spring. A transverse plate connecting the bifurcated arms engages the underside of a rocker arm as the bifurcated arms are positioned on the bracket supporting the rocker arm to enable pivoting the rocker arm and permit removal of the engine push rod.

6 Claims, 3 Drawing Sheets

PUSH ROD REMOVAL TOOL

BACKGROUND OF THE INVENTION

The present invention relates to a tool useful for effecting removal of a push rod from an internal combustion engine.

Typically, multiple stroke, internal combustion engines include push rods which are mechanically linked to valves that open and close ports to the cylinders of the engine. Most often, one end of each push rod is reciprocally driven in response to actuation by a rotating cam. The opposite end of each push rod typically engages one end of a rocker arm which is pivotally biased by a valve spring causing the opposite end of the rocker arm to engage with the push rod. Thus, as the cam rotates, the push rod reciprocates causing the rocker arm to pivot against the biasing force of a valve spring assembly and thereby open or enable closure of a valve port of the internal combustion engine.

A repair operation often necessary with respect to internal combustion engines is replacement of the intake manifold gasket which, in turn, may require removal of the intake manifold. On some engines the push rods must also be removed to allow the gasket surfaces to be cleaned prior to installation of a new gasket. Removal of push rods from an internal combustion engine, however, is not a straightforward mechanical operation. Various means must be employed in order to move the rocker arm out of engagement with the push rod so that the push rod may be effectively removed and replaced. Factors which complicate replacement may include the time and effort to remove parts of the engine in order to secure adequate access to the push rods. An effective, efficient and simple means for removal of push rods thus is an objective long sought by engine mechanics.

U.S. Pat. No. 7,409,755 entitled "Push Rod Removal Tool" issued Aug. 12, 2008, incorporated herein by reference, describes a tool designed to facilitate removal of push rods. The tool performs well in many circumstances. However, changes in engine design may inhibit the effective use of the described tool in some situations. Specifically, the described tool may be too bulky or may have a configuration which may preclude effective use in constricted spaces. This problem arises, for example, in General Motors 3.5L and 3.9L engines. Thus, there is a need for a tool which will enable efficient repair of such engines and in other similar circumstances involving space constraints.

SUMMARY OF THE INVENTION

Briefly, the present invention comprises a tool for engaging a rocker arm associated with an internal combustion engine push rod in a manner which imparts pivotal movement of the rocker arm out of engagement with the push rod so that the push rod may be easily removed and replaced. The tool is comprised of a handle joined to first and second spaced or bifurcated lever arms which are connected or joined at a distal end of the tool opposite the handle to a depending prong. A single, transverse bridging member or plate with a slot extends partially over a recess or indentation along the lower edge of the spaced lever arms adjacent the depending prong.

In use, the spaced first and second lever arms are positioned against the rocker arm support bracket and the transverse cross member or plate, attached to the first and second lever arms is positioned to engage the bottom side of one end of the rocker arm so that the tool may be manually rotated thereby pivoting or rotating the rocker arm about its support bracket axis and against the spring force of the associated engine valve spring. Rotation of the rocker arm out of engagement with the push rod is thus effected by engaging the cross member or plate of the tool with the underside of the rocker arm so that the depending prong may impact or drive the valve spring. Manipulating the tool rotates the rocker arm about its support axis thereby releasing the rocker arm from engagement with the associated push rod.

The tool handle optionally includes a means for effective extension by engagement with a socket wrench. The tool may be formed from two mirror image, flat stock strips of metal that are stamped, notched, and welded together.

Thus, it is an object of the invention to provide an improved tool capable of effecting pivotal or rotational movement to a rocker arm in order to remove the associated push rod thus facilitating necessary repair work.

A further object of the invention is to provide a tool which will provide a mechanic with a mechanical advantage upon engagement and pivoting a rocker arm of an internal combustion engine.

Yet another object of the invention is to provide a rugged, yet economical tool useful for engaging a rocker arm in order to effect removal of a push rod from an internal combustion engine.

Yet a further object of the invention is to provide a tool for use with internal combustion engines to effect removal of a push rod by engaging the rocker arm associated with the push rod while simultaneously depressing the valve spring, particularly when access space to engage the rocker arm is constrained or limited.

A further object of the invention is to provide a rocker arm engagement tool which may be comprised of an assembly of generally planar plates including a handle, an intermediate rocker arm engagement section and an end prong section and having a narrow or low profile to enable use in restricted spaces.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF AN EMBODIMENT OF THE INVENTION

Figure 1:
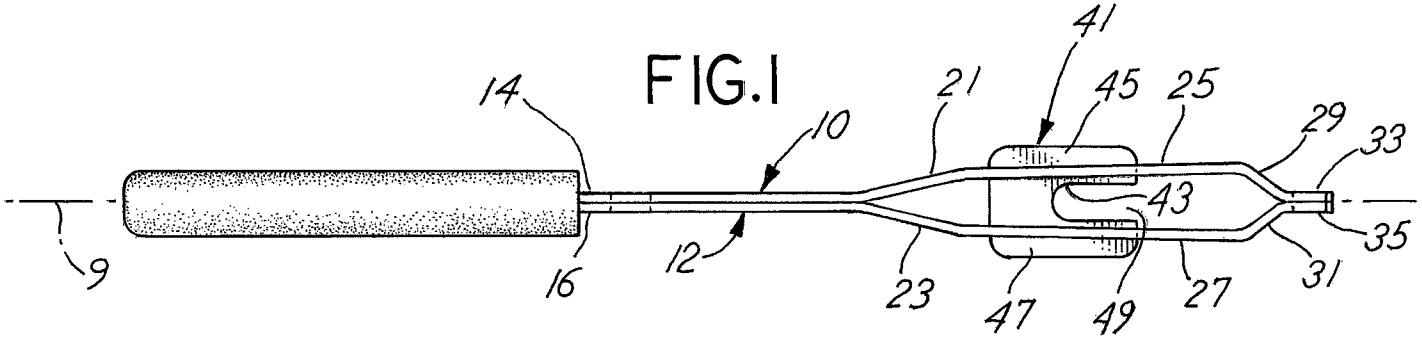
FIG. 1 is a top plan view of the push rod removal tool of the invention.
Figure 2:
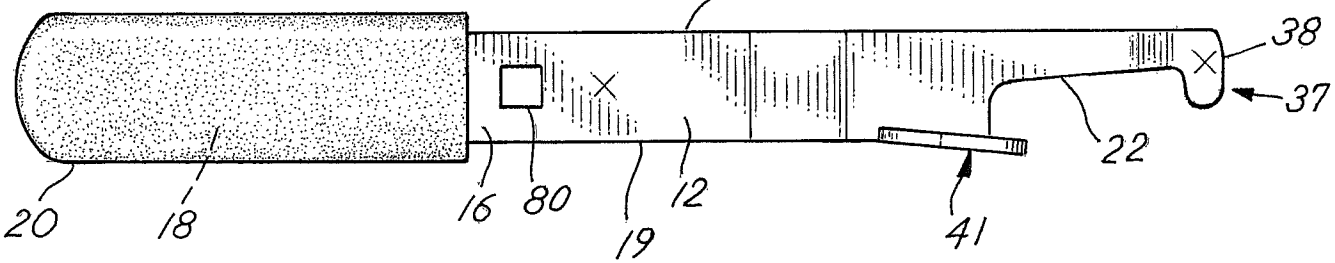
FIG. 2 is a side elevation of the tool of FIG. 1.
Figure 3:
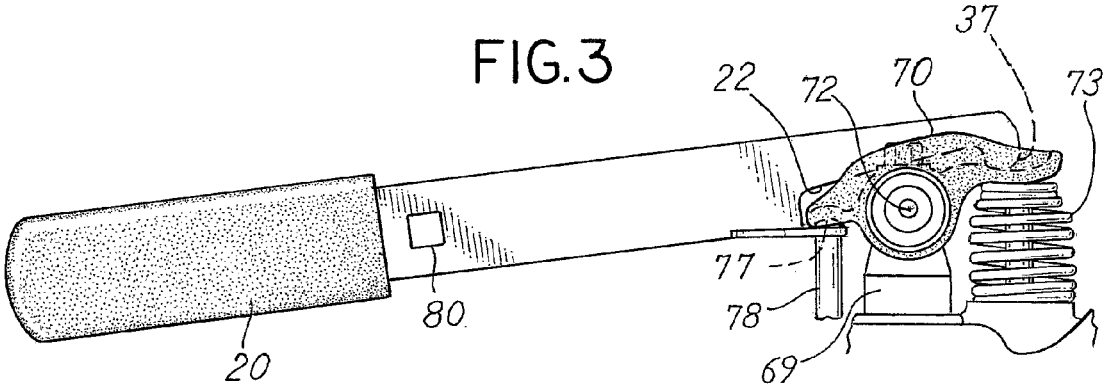
FIG. 3 is a side view of the tool of the invention that has been manipulated to compress the rocker arm spring so as to enable removal of a push rod from an internal combustion engine.
Figure 4:
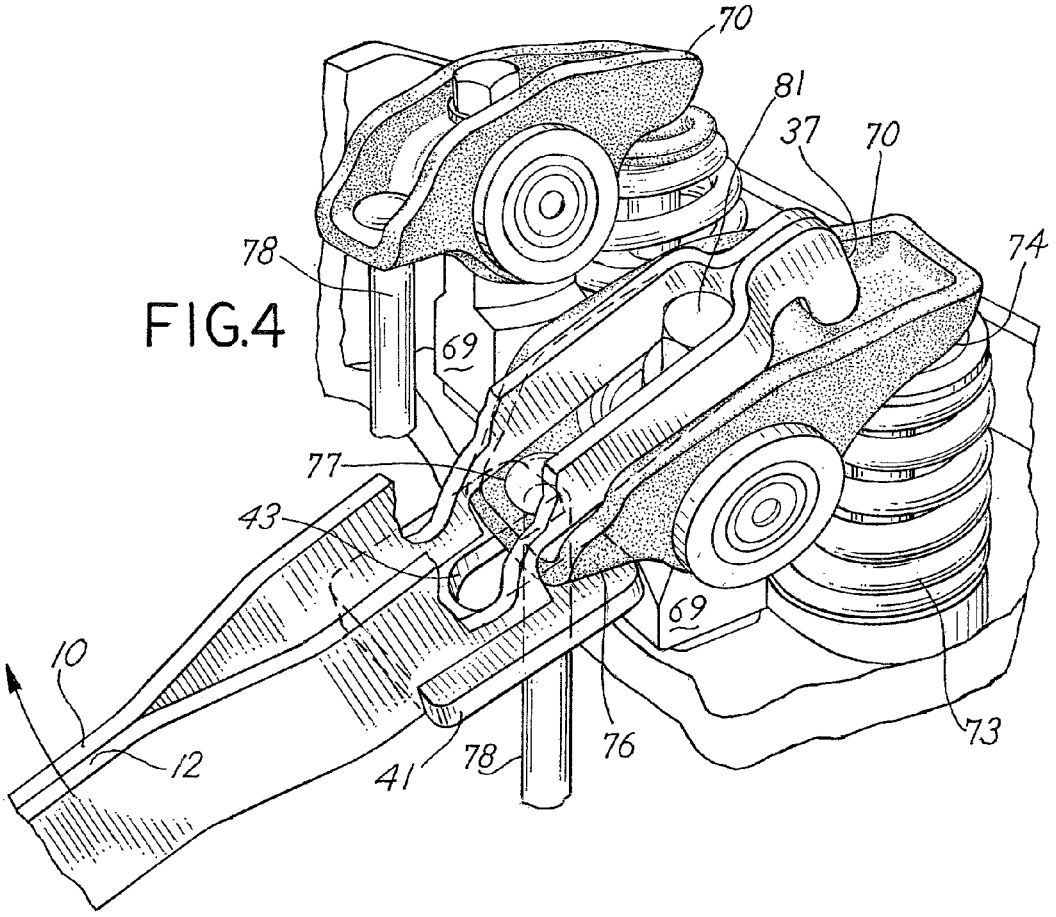
FIG. 4 is an isometric view of the tool of the invention illustrating the manner of use.
Figure 5:
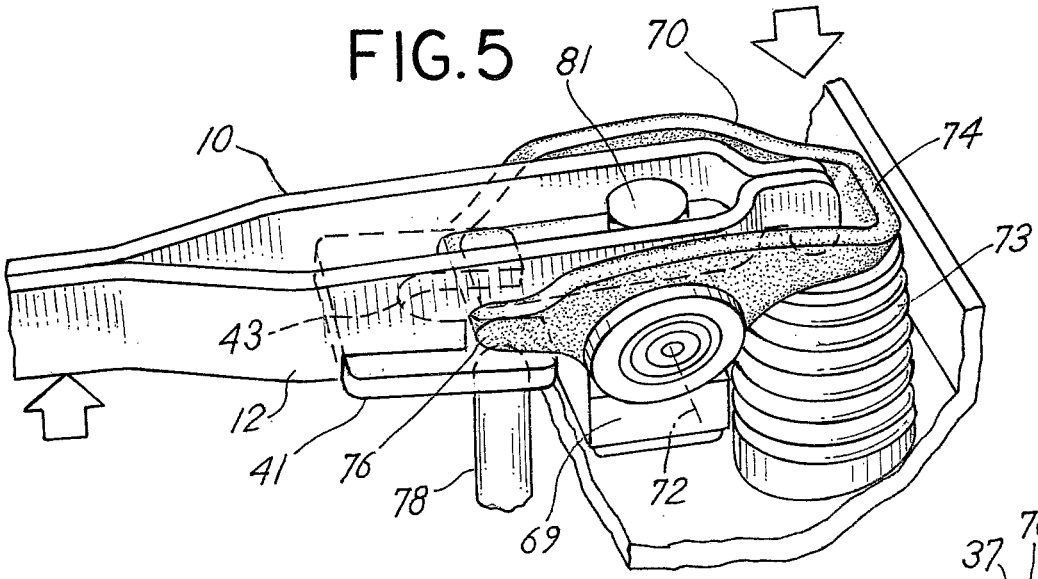
FIG. 5 is another isometric view illustrating the use of the tool.

A typical internal combustion engine will include a plurality of rocker arms each mounted on a transverse pivot axis or pivot shaft support bracket with one end of the rocker arm projecting transversely outwardly from the pivot axis to engage a push rod associated with the operation of a cam shaft of the internal combustion engine and wherein the oppositely projecting end of the rocker arm is biased by a valve compression spring mounted in a recess or counterbore in the cylinder head of the engine. The compression spring effectively engages or connects to the rocker arm thereby biasing it about its pivot axis into engagement with the push rod. An object of the invention is to provide a tool which will pivot the rocker arm against the compression force of the valve spring mounted on the engine block or cylinder head in a manner which enables the push rod to be moved independently away from engagement with the rocker arm enabling access and removal of the push rod. FIGS. 1 and 2 depict an embodiment of the tool and FIGS. 3-6 depict utilization of the tool of FIGS. 1 and 2. The tool is designed for use in restricted or minimal space such as experienced in various recently designed vehicle engines.

Referring to FIGS. 1 and 2, the tool is comprised of a first elongate frame member 10 and a second generally mirror image elongate frame member 12. The frame member 10 includes a longitudinal handle section 14 and the frame member 12 includes a longitudinal handle section 16. The longitudinal runs comprising the handle sections 14 and 16 are joined together by welding or fasteners or the like and include a distal or hand grip end 18 with an attached, molded hand grip 20. The handle sections 14 and 16 extend in the range of 8 to 20 inches in longitudinal length along a longitudinal axis 9. In the embodiment depicted, the frame members 10, 12 comprise flat planar plates having an elongate generally straight top edge 17 and a generally straight, parallel bottom edge 19 with a recess 22 in the bottom edge 19.

Frame members 10 and 12 further include, respectively, an acutely diverging connection section 21, 23 joined, respectively, to a generally parallel, spaced, medial section 25, 27. Medial sections 25, 27 are joined, respectively, to convergent sections 29, 31 which connect respectively to end sections 33, 35. The end sections 33, 35 are joined to form a terminal section comprising an end prong 37 with a distal outer end 39. The end prong 37 extends toward the lower or second edge 19, and is generally coaxial with axis 9 and is generally coplanar with the handle sections 14, 16. Further, the end prong 37 comprises or defines an outer boundary or limit of the recess 22. The medial sections 25, 27 comprise spaced side plates and are spaced in the range of ½ to about 2 inches from each other.

A slotted rocker arm lift plate 41 is attached to the lower or bottom edge 19 of the medial sections 25, 27 adjacent the diverging sections 21, 23. Plate 41 includes an axial extending, medial slot 43 with an open end 49 adjacent recess 22 and directed toward prong 37. Plate 41 further includes lateral wings 45, 47 extending outwardly from diverging sections 21, 23 and partially over the recess 22. Extension of a plane defined by plate 41 diverges slightly from the recess 22 and away from intersecting with prong 37.

Figure 6:
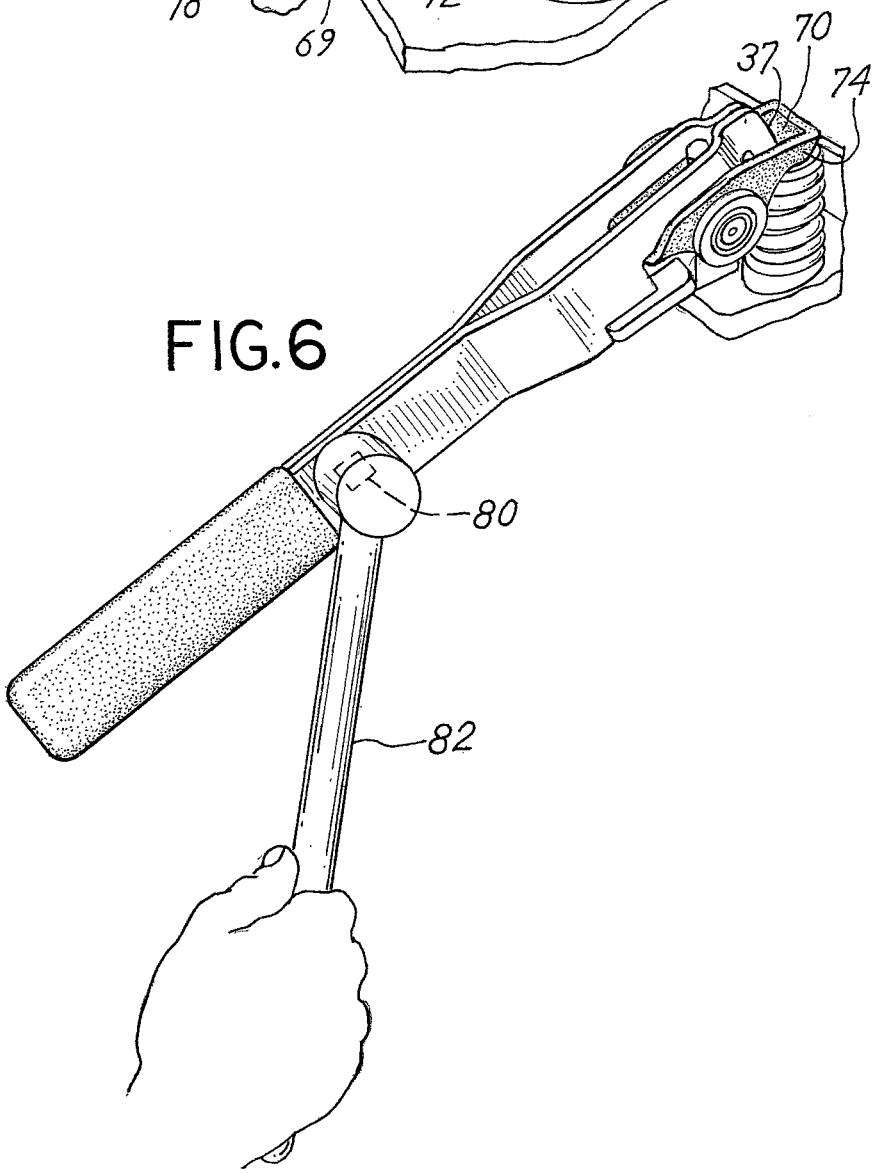
FIG. 6 is another isometric view illustrating use of the tool.

As depicted in the figures, an optional feature of the invention is the inclusion of a socket opening 80 formed in the frame members 10 and 12 and, more particularly, formed in the handle sections 14, 16 of the frame members 10, 12 which are joined together. The socket opening 80 is typically a square passage or polygonal shaped passage which enables the insertion of a socket wrench 82 or other device to provide a longer lever arm or mechanical advantage during use of the tool. FIG. 6 illustrates this feature wherein a socket wrench 82 may be positioned to engage socket opening 80.

Referring to FIGS. 3-6, there is depicted the tool positioned for engagement with a rocker arm assembly. Thus, a rocker arm assembly includes a rocker arm 70 pivotally mounted on a pivot block or bracket 69 for rotation about an axis 72. Arm 70 includes an outer valve spring engaging end 74 and an opposite push rod engaging end 76. The push rod engaging end 76 is designed to engage with a push rod 78 which fits into a pocket or recess 77 in the push rod end 76. The rocker arm 70 thus pivots about the axis 72 of the rocker arm assembly.

The tool of the invention may be inserted as depicted in the figures so that the handle (formed by sections 14, 16) is directed away from the push rod 78 with the plate 41 engaged with the bottom of the push rod end 76 of the rocker arm 70. The spaced medial sections 25, 27 permit a fastener 81, associated with the rocker arm pivot block or bracket 69, to be positioned between them. The prong 37 extends over the top side of rocker arm 70 and engages the valve spring end 74 of the rocker arm 70. The second or lower surface 19 of the recess 22 fits over the rocker arm 70. Plate 41 is positioned against the underside of the push rod end 76 with slot 43 fitted around push rod 78. Push rod end 76 is thereby nestled in recess 22 between plate 41 and lower edge 19.

The push rod end 76 of the rocker arm 70 may thus be driven or pivoted about axis 72 upwardly in the figures in the direction of the arrow with the pivot block or bracket 69 acting as a fulcrum in order to compress the spring 73 of the valve spring assembly. In this manner, the rocker arm 70 is lifted out of a biased position and the push rod 78 may be easily manipulated and removed from pocket or recess of rocker arm 70 and the engine block to effect repair without removal of the rocker arm 70 or pivot block 69. To reinsert the push rod 78, the reverse operation may be performed. Thus, with the construction of the present invention, the spaced medial plates 25, 27 in combination with the recess 22, slotted plate 41 and the prong 37 may be inserted in extremely constricted spaces to effect engine repair.

The shape of the recess 22, the prong 37, the dimensions of the tool, the spacing of the plates 25, 27, and various other features and elements of the invention may be amended or altered without departing from the spirit and scope of the invention. The use of mirror image members 10, 12 to form the tool is a further advantage in that the manufacture and assembly of the tool is facilitated by the use of plate stock in order to manufacture the component parts which may be easily assembled. Thus, while there has been set forth an embodiment of the invention, it is to be understood the invention is limited only by the following claims and equivalents thereof.

What is claimed is:

1. A manually operable reduced profile, motor vehicle engine, rocker arm engagement, push rod removal tool comprising:

a frame assembly including a first and a second side frame member, said first side frame member having a generally flat line top edge and formed from a generally uniformly thick, unitary metal plate having a flat, planar handle section extending in the direction of an axis, said handle section joined to an outwardly, acutely diverging, connection section diverging from the axis and the plane of said handle section, said diverging connection section joined to a medial section, generally parallel to the handle section, said medial section joined to a convergent connection section joined to a terminal end section, said terminal end section generally coplanar with the handle section and including a terminal depending outer end prong directed downwardly from the top edge, said first side frame member having a side profile configuration viewed transversely to the longitudinal axis of said first frame member of said handle section and said diverging section comprising a lower edge generally parallel to the top edge, said medial section including a bottom side generally comprising an extension portion from the diverging section lower edge with an elongate recess extending axially from the extension portion, and said terminal end section outer end prong including a prong lower edge;

said second side frame member formed as a mirror image of said first side frame member, said first and second side frame members fastened together with said handle section and said terminal end sections joined in abutting relation and said medial sections generally parallel and spaced from each other; and a slotted plate attached to said generally bottom side extension portions of the medial sections of the frame members, said slotted plate projecting from the generally bottom side extension portions of the medial sections partially under the elongate recess in a plane transverse to the plane of said handle sections of said first and second side frame members, said slotted plate including an axially extending slot with an open end, said slot open end projecting toward said prong and transverse to said prong, said slotted plate defining a projected plane below the lower edge of said outer end prong and defining a gap between said plate and the elongate recess.

2. A tool for engaging and pivoting a rocker arm of an internal combustion engine to enable removal of a push rod from the engine by disengaging the rocker arm from the push rod comprising:

a longitudinal handle defining a longitudinal axis;

first and second generally parallel, spaced side plates connected to the handle and extending axially from the handle, said side plates including an elongate, substantially identical axially extending recess extending partially along a plate lower edge of each side plate;

an end prong formed by an extension of said side plates, said prong generally coaxial with said axis and extending from and connected to the first and second side plates, said prong directed transversely from said axis in the direction of the lower edge of said side plates, said prong including a prong lower edge section for engaging a rocker arm; and a rocker arm lift plate affixed to said spaced first and second side plates and projecting partially under the elongate recess in said side plates, said recess adapted to engage a rocker arm support and pivot about a fulcrum intermediate the lift plate and the prong lower edge.

3. The tool of claim 2 wherein said rocker arm lift plate includes an elongate slot with a first open end in the space between said spaced side plates with an opening toward the prong for access to a rod, said plate extending transversely from the spaced side plates to engage and pivot said rocker arm.

4. The tool of claim 2 wherein said side plates are flat and have a generally uniform thickness.

5. The tool of claim 2 wherein said rocker arm lift plate includes an opening therethrough intermediate the spaced side plates for access to a rod.

6. The tool of claim 2 wherein said plate extends transversely from said spaced side plates.

* * * * *